US008900158B2

(12) United States Patent
Kasama

(10) Patent No.: US 8,900,158 B2
(45) Date of Patent: Dec. 2, 2014

(54) EXERCISE MONITORING DEVICE, EXERCISE MONITORING PROGRAM STORAGE MEDIUM, AND EXERCISE MONITORING METHOD

(75) Inventor: Koichiro Kasama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 193 days.

(21) Appl. No.: 12/068,567

(22) Filed: Feb. 7, 2008

(65) Prior Publication Data

US 2008/0220940 A1 Sep. 11, 2008

(30) Foreign Application Priority Data

Mar. 9, 2007 (JP) ..... 2007-060487

(51) Int. Cl.

| | |
|---|---|
| ***A63B 71/00*** | (2006.01) |
| ***A61B 5/02*** | (2006.01) |
| ***A63B 24/00*** | (2006.01) |
| ***A63B 69/00*** | (2006.01) |
| *A63B 71/06* | (2006.01) |

(52) U.S. Cl.

CPC ..... *A63B 24/0062* (2013.01); *A63B 69/0028* (2013.01); *A63B 2024/0065* (2013.01); *A63B 2071/063* (2013.01); *A63B 2230/065* (2013.01)

USPC ..... 600/500; 482/8; 482/9; 600/481

(58) Field of Classification Search

USPC ..... 600/519–520

See application file for complete search history.

(56) References Cited

U.S. PATENT DOCUMENTS

| | | | | |
|---|---|---|---|---|
| 4,367,752 | A * | 1/1983 | Jimenez et al. | 600/502 |
| 4,776,583 | A * | 10/1988 | Jennings | 482/63 |
| 5,474,077 | A | 12/1995 | Suga | |
| 5,603,330 | A | 2/1997 | Suga | |
| 5,941,837 | A | 8/1999 | Amano et al. | |
| 6,176,241 | B1 * | 1/2001 | Blau et al. | 128/898 |
| 6,549,756 | B1 * | 4/2003 | Engstrom | 455/66.1 |
| 2004/0171956 | A1 * | 9/2004 | Babashan | 600/509 |
| 2006/0098848 | A1 | 5/2006 | Nagasaka et al. | |
| 2006/0148619 | A1 | 7/2006 | Tsubata et al. | |

FOREIGN PATENT DOCUMENTS

| | | | | |
|---|---|---|---|---|
| JP | 5-220120 | | 8/1993 | |
| JP | 05-220120 | A * | 8/1993 | A61B 5/0245 |
| JP | 5-70503 | | 9/1993 | |
| JP | 6-197892 | | 7/1994 | |

(Continued)

OTHER PUBLICATIONS

Korean Office Action issued on Nov. 26, 2009 in corresponding Korean Patent Application 10-2008-0019317.

(Continued)

*Primary Examiner* — Michael D'Angelo

(74) *Attorney, Agent, or Firm* — Staas & Halsey LLP

(57) ABSTRACT

An exercise monitoring device includes: a setting section which sets a user's age and resting pulse rate; a calculating section which calculates a pulse rate range of aerobic exercise on the basis of the age and the resting pulse rate set by the setting section; a sensor which measures a working pulse rate of the user; a monitoring section which monitors whether or not the pulse rate measured by the sensor is within the pulse rate range calculated by the calculating section; and a notifying section which notifies the user of a result of monitoring obtained by the monitoring section.

2 Claims, 8 Drawing Sheets

(56) References Cited

FOREIGN PATENT DOCUMENTS

| | | |
|---|---|---|
| JP | 8-95115 | 4/1996 |
| JP | 09-238911 | 9/1997 |
| JP | 2000-308639 | 11/2000 |
| JP | 2001-296166 | 10/2001 |
| JP | 2002-360734 | 12/2002 |
| JP | 2003-144392 | 5/2003 |
| JP | 2003-250765 | 9/2003 |
| JP | 2006-155575 | 6/2006 |
| JP | 2006-187469 | 7/2006 |
| KR | 2001-0000055 | 1/2001 |
| KR | 10-2006-0031837 | 4/2006 |

OTHER PUBLICATIONS

Japanese Office Action issued Jul. 31, 2012 in corresponding Japanese Patent Application No. 2007-060487.

Japanese Office Action for corresponding Japanese Patent Application No. 2007-060487, issued on Dec. 27, 2011.

Japanese Office Action mailed Mar. 5, 2013 for corresponding Japanese Application No. 2007-060487.

Patent Abstracts of Japan, Japanese Publication No. 07-148128, Published Jun. 13, 1995.

Exercise guide for health promotion 2006—To prevent lifestyle diseases—http://www.mhlw.go.jp/bunya/kenkou/undou01/pdf/data.pdf, Partial pp. 5-8.

Using heart rate as a guide for exercise intensity, http://www.mizuno.co.jp/card/report/no007/no7_2.html, Partial.

Aerobic Exercise, http://www.health-net.or.jp/kenkozukuri/healthnews/030/010/c7003/index.html.

T. Yamamoto et al., Current trends in exercise prescription, http://www.hc.keio.ac.jp/sports/ronbun/99kiyo/kojin/01yamamoto.pdf, Partial pp. 35-36.

* cited by examiner

| NOTICE SUMMARY | NOTICE TIMING | NTIFYING CONTENT |
|---|---|---|
| NOTICE OF AMOUNT OF EXERCISE | SPECIFIED TIME CYCLE AFTER LAPSE OF 10 SECONDS FROM MEASUREMENT START | "AMOUNT OF EXERCISE PERFORMED TODAY IS ○○ METS·H." |
| GUIDANCE NOTICE OF AEROBIC EXERCISE | SPECIFIED TIME CYCLE AFTER LAPSE OF 10 SECONDS FROM MEASUREMENT START | "YOU ARE NOT DOING AEROBIC EXERCISE, SO INCREASE SPEED TO ○○M/MINUTE."<br>"YOU ARE NOT DOING AEROBIC EXERCISE, SO DECREASE SPEED TO ○○M/MINUTE."<br>"YOU ARE DOING AEROBIC EXERCISE." |
| NOTICE OF EXERCISE INTENSITY | SPECIFIED TIME CYCLE AFTER LAPSE OF 10 SECONDS FROM MEASUREMENT START | "EXERCISE INTENSITY AT MOMENT IS ○○ METS." |

Fig. 4

| PERCENTAGE WITH RESPECT TO MAXIMUM HEART RATE RESERVE [%] | PULSE RATE [1/MIN] | EXERCISE INTENSITY [METS] | SPEED [M/MIN] |
|---|---|---|---|
| 30～39% | 112～121 | 2 | 30～50 |
| 40～49% | 122～132 | 2.5 | 51～69 |
| 50～59% | 133～142 | 3 | 70～107 |
| 60～69% | 143～153 | 5 | 108～119 |
| 70～79% | 154～164 | 7 | 120～159 |
| 80%～ | 165～ | 10 | 160～ |

Fig. 5

| NOTICE SUMMARY | NOTICE TIMING | NOTIFYING CONTENT |
|---|---|---|
| NOTICE OF AMOUNT OF EXERCISE | SPECIFIED TIME CYCLE AFTER LAPSE OF 10 SECONDS FROM MEASUREMENT START | "AMOUNT OF EXERCISE PERFORMED TODAY IS ○○ METS·H" |
| GUIDANCE NOTICE OF AEROBIC EXERCISE | SPECIFIED TIME CYCLE AFTER LAPSE OF 10 SECONDS FROM MEASUREMENT START | "YOU ARE NOT DOING AERBIC EXERCISE, SO INCREASE IN PACE A LITTLE MORE SO THAT EXERCISE INTENSITY BECOMES ○○ METS"<br><br>"YOU ARE NOT DOING AERBIC EXERCISE, SO DECREASE IN PACE A LITTLE MORE SO THAT EXERCISE INTENSITY BECOMES ○○ METS"<br><br>"YOU ARE DOING AEROBIC EXERCISE" |
| NOTICE OF EXERCISE INTENSITY | SPECIFIED TIME CYCLE AFTER LAPSE OF 10 SECONDS FROM MEASUREMENT START | "EXERCISE INTENSITY AT MOMENT IS ○○ METS" |

Fig. 8

EXERCISE MONITORING DEVICE, EXERCISE MONITORING PROGRAM STORAGE MEDIUM, AND EXERCISE MONITORING METHOD

BACKGROUND OF THE INVENTION

1. Field of the Invention

The present invention relates to an exercise monitoring device and an exercise monitoring method, both of which monitor whether or not aerobic exercise is being performed and notify the result to a user practicing exercise, and relates to an exercise monitoring program storage medium storing an exercise monitoring program that is executed in a computing device and makes the computing device operate as the exercise monitoring device.

2. Description of the Related Art

Various exercise machines have been developed riding a wave of fitness boom in recent years and become familiar to many users. There are many cases where such various kinds of exercise machines are provided with a display device which calculates exercise intensity from a user's pulse rate or the like and outputs the same (for example, see Japanese Patent Application Publication No. 5-220120, Japanese Patent Application Publication No. 6-197892, and Japanese Utility Model Application Publication No. 5-70503). However, known devices obtain the exercise intensity from age, a pulse rate, and the like; and consequently, only inaccurate exercise intensity can be obtained at present. Furthermore, heretofore, there is a device which prompts a user to do aerobic exercise by obtaining whether or not the user is practicing aerobic exercise, or whether or not the exercise is weaker than the aerobic exercise, or harder than the aerobic exercise from the user's age, weight, pulse rate, and the like. However, since such data is based on originally incorrectly obtained exercise intensity, it is not correctly obtained whether or not the aerobic exercise suitable for the user is done; therefore, the user adjusts the exercise intensity on the basis of inaccurate information at present.

On the other hand, in recent years, guidance for exercise is disclosed in http: //www.mhlw.go.jp/bunya/kenkou/undou01/pdf/data.pdf) from the Ministry of Health, Labor and Welfare. Furthermore, in http://www.mizuno.co.jp/card/report/no007/no7_2.html and http://www.health-net.or.jp/kenkozukuri/healthnews/030/010/c7003/index.html, relation between aerobic exercise and the maximum heart rate reserve is shown. Further, in http://www.hc.keio.ac.jp/sports/ronbun/99kiyo/kojin/01yamam oto.pdf, definition of metabolic equivalents (referred to as METs) proposed by the American College of Sports Medicine is disclosed.

SUMMARY OF THE INVENTION

The present invention has been made in view of the above circumstances and provides an exercise monitoring device and an exercise monitoring method, both of which can correctly monitor whether or not aerobic exercise is being performed for each user, and to provide an exercise monitoring program storage medium storing an exercise monitoring program that makes a computing device operate as the exercise monitoring device which can correctly monitor whether or not the aerobic exercise is being performed for each user.

According to the present invention, there is provided an exercise monitoring device including:

a setting section which sets a user's age and resting pulse rate;

a calculating section which calculates a pulse rate range of aerobic exercise on the basis of the age and the resting pulse rate set by the setting section;

a sensor which measures a working pulse rate of the user;

a monitoring section which monitors whether or not the pulse rate measured by the sensor is within the pulse rate range calculated by the calculating section; and a notifying section which notifies the user of a result of monitoring obtained by the monitoring section.

In a conventional device which calculates exercise intensity, exercise intensity calculation is carried out without taking into account a user's resting pulse rate. On the other hand, the exercise monitoring device of the present invention calculates a pulse rate range in which aerobic exercise suitable for the user is performed on the basis of both user's age and resting pulse rate by setting the user's resting pulse rate other than the user's age; therefore, the exercise monitoring device can correctly monitor whether or not the user is doing aerobic exercise and notify the result to the user.

In the exercise monitoring device of the present invention, it is preferable that the calculating section calculates the pulse rate range, by storing beforehand a maximum percentage and a minimum percentage of aerobic exercise with respect to a maximum heart rate reserve, and calculating upper and lower limits of pulse rates respectively corresponding to the maximum and minimum percentages.

Furthermore, in this case, it is preferable that in accordance with an equation: pulse rate=resting pulse rate+[(220−age)−resting pulse rate]×(x/100), when a percentage with respect to the maximum heart rate reserve is x %, the calculating section calculates the pulse rate range by inputting the maximum and minimum percentages of aerobic exercise with respect to the maximum heart rate reserve as the x, and calculating the upper and lower limits of pulse rates.

In accordance with the aforementioned equation, a user's pulse rate range of aerobic exercise can be easily calculated by storing beforehand maximum and minimum percentages of aerobic exercise with respect to the maximum heart rate reserve.

Still furthermore, in the exercise monitoring device of the present invention, it is preferable to include a memory section which stores a corresponding table between a percentage with respect to the maximum heart rate reserve and exercise intensity in which METs is the unit, and the notifying section further notifies the user of exercise intensity obtained from the pulse rate measured by the sensor and the corresponding table and/or an amount of exercise that is temporal accumulation of the exercise intensity.

A user can correctly know exercise intensity (or amount of exercise) of exercise done (or being done) by the user by storing the corresponding table between the percentage with respect to the maximum heart rate reserve and the exercise intensity in which METs is the unit and notifying the exercise intensity (or amount of exercise that is temporal accumulation) in which METs is the unit.

Further, according to the present invention, there is provided an exercise monitoring program storage medium storing an exercise monitoring program which is executed in a computing device which a sensor that measures a working pulse rate of the user is connected to or mounted on, and which makes the computing device operate as an exercise monitoring device that includes:

a setting section which sets a user's age and resting pulse rate;

a calculating section which calculates a pulse rate range of aerobic exercise on the basis of the age and the resting pulse rate set by the setting section;

a monitoring section which monitors whether or not the pulse rate measured by the sensor is within the pulse rate range calculated by the calculating section; and a notifying section which notifies the user of a result of monitoring obtained by the monitoring section.

Still further, according to the present invention, there is provided an exercise monitoring method which is executed in an exercise monitoring device which a sensor that measures a working pulse rate of the user is connected to or mounted on, the exercise monitoring method including the steps of:

setting a user's age and resting pulse rate;

calculating a pulse rate range of aerobic exercise on the basis of the age and the resting pulse rate set in the step of setting;

monitoring whether or not the pulse rate measured by the sensor is within the pulse rate range calculated in the step of calculating; and notifying the user of a result of monitoring obtained in the step of monitoring.

Only the basic features are respectively described above for the exercise monitoring program storage medium and the exercise monitoring method of the present invention; however, the exercise monitoring program storage medium and the exercise monitoring method of the present invention include features corresponding to the various additional features of the exercise monitoring device of the present invention.

According to the present invention, a user's resting pulse rate serves as a calculation base; therefore, correct exercise intensity in aerobic exercise can be obtained for the user, so that correct information can be conveyed to the user.

BRIEF DESCRIPTION OF THE SEVERAL VIEWS OF THE DRAWING

FIG. 4 is a view showing a list of notice summary, notice timing, and notifying content;

FIG. 5 is a view showing a maximum heart rate reserve conversion table;

FIG. 8 is a view showing a list of notice summary, notice timing, and notifying content as an alternative to the list shown in FIG. 4.

DETAILED DESCRIPTION OF THE INVENTION

Embodiments of the present invention will be described below. In this case, there will be described a mobile phone in which a function serving as an exercise monitoring device of one embodiment of the present invention is incorporated.

Figure 1:
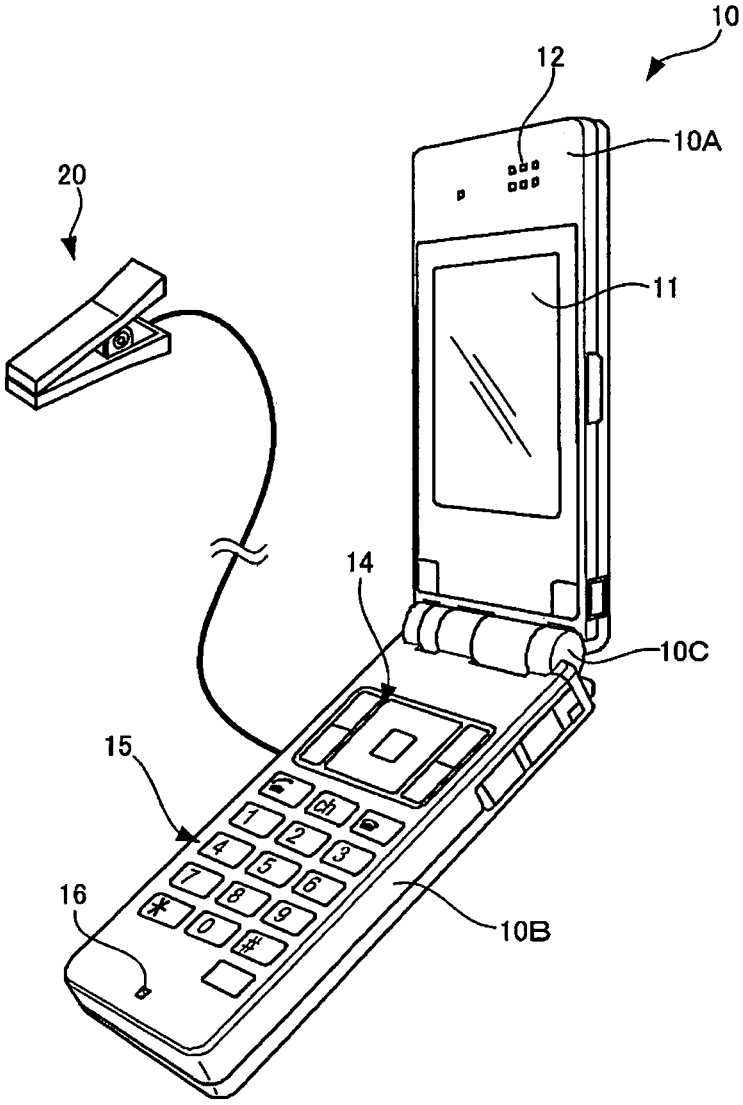
FIG. 1 is a view showing a mobile phone and a pulse sensor connected to the mobile phone.

FIG. 1 is a view showing a mobile phone and a pulse sensor connected to the mobile phone.

A mobile phone 10 shown in FIG. 1 has an upper case 10A to be placed in contact with an ear by a user at the time of phone call and a lower case 10B to be held by the user in his/her hand, the upper case 10A and the lower case 10B being pivotally and collapsibly coupled around the center of a hinge portion 10C.

The upper case 10A includes a liquid crystal panel 11 where a menu screen, a photograph image, and the like are displayed; and an ear piece 12 equipped with a speaker inside thereof for releasing sound emitted from the speaker.

Further, the lower case 10B includes selection buttons 14 used for selecting various functions and used as a shutter button at the time of photographing, push buttons 15 for inputting phone numbers and the like, and a mouthpiece 16 equipped with a microphone inside thereof for transmitting voice to the microphone.

Furthermore, a pulse sensor 20 is detachably connected to the mobile phone 10. The pulse sensor 20 is a clip type sensor which nips a human earlobe and measures a pulse by detecting the pulse in blood flow of the earlobe by an optical sensor.

Figure 2:
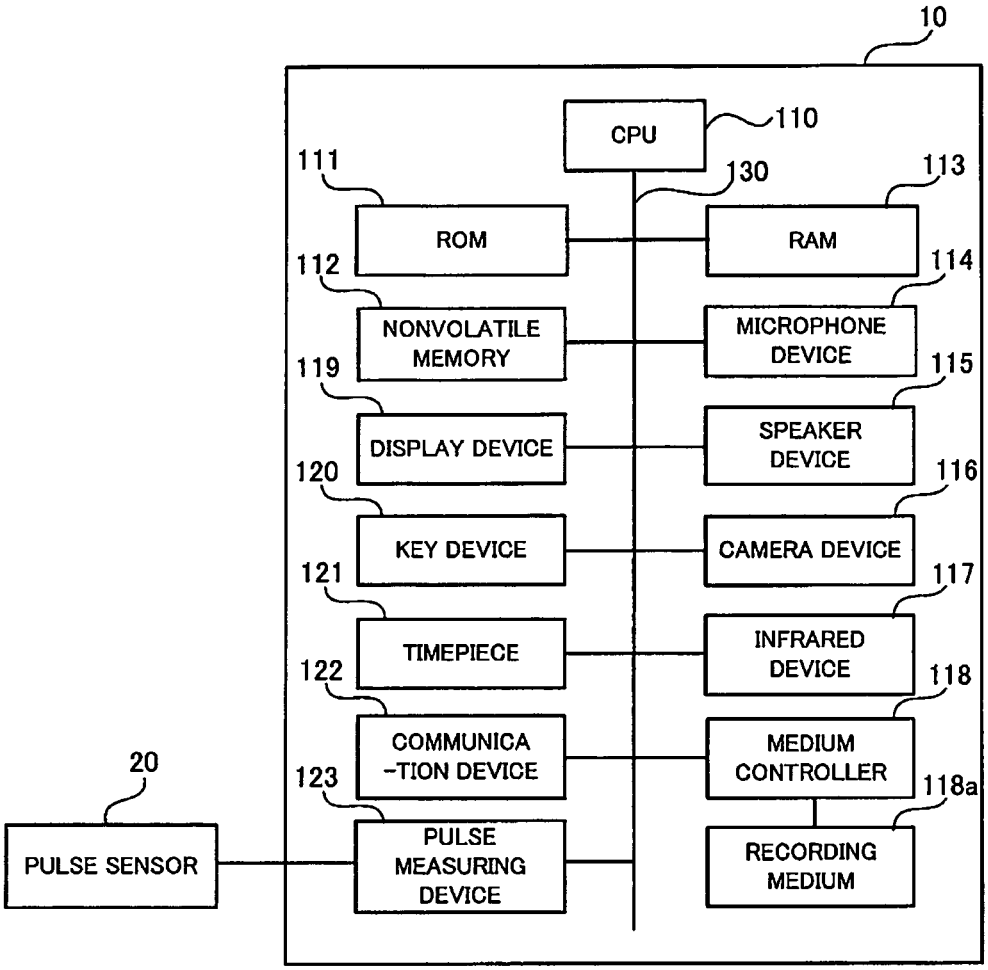
FIG. 2 is an internal block diagram of the mobile phone shown in FIG. 1.

FIG. 2 is an internal block diagram of the mobile phone shown in FIG. 1.

In FIG. 2, the mobile phone 10 and the pulse sensor 20 are each shown as a block. In the mobile phone 10 shown in FIG. 2, as a block constituting the mobile phone 10, there are shown a central processing unit (referred to as CPU) 110, a read only memory (referred to as ROM) 111, a nonvolatile memory 112, a random access memory (referred to as RAM) 113, a microphone device 114, a speaker device 115, a camera device 116, an infrared device 117, a medium controller 118, a display device 119, a key device 120, a timepiece 121, a communication device 122, and a pulse measuring device 123; and these are connected via a bus 130 with each other.

The CPU 110 has a function for executing various programs, and controls the entire mobile phone 10.

The ROM 111 stores various programs to be executed by the CPU 110 and various constants necessary for executing the various programs; the CPU 110 executes the programs stored in the ROM 111 while using the RAM 113 as a work area.

The nonvolatile memory 112 stores possibly rewritable various kinds of information such as address book, received e-mails, and the like.

The microphone device 114 is a microphone for picking up user's voice and a functional block which processes the voice picked up by the microphone.

The speaker device 115 is a speaker which outputs sound to a user and a functional block which generates a sound signal for driving the speaker.

The camera device 116 is a block which collects image data by photographing; the display device 119 is a block which displays images on the liquid crystal panel 11 (see FIG. 1); the key device 120 is a block which detects various kinds of key operations by a user; and the timepiece 121 is a block which is for acquiring the current time.

The medium controller 118 is for reading data from a loaded recording medium 118*a*, and for writing image data or the like generated by the camera device 116 to the recording medium 118*a*.

The infrared device 117 is for sending images and phone numbers by infrared communication to an external device located at a short distance without going through a predetermined base station or the like.

In addition, the communication device 122 is for realizing a phone call function in the mobile phone 10.

Further, the pulse measuring device 123 is a device for obtaining a pulse by receiving a detection signal representing pulse in blood flow from the pulse sensor.

The mobile phone 10 shown here is basically configured as described above.

Figure 3:
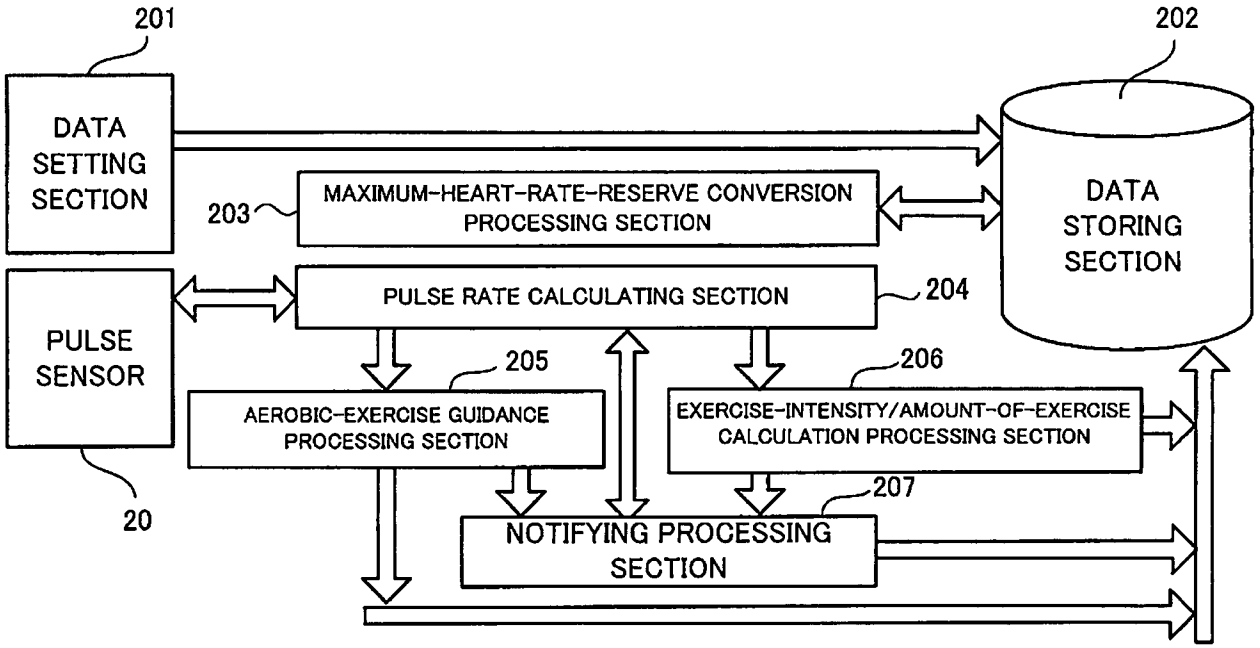
FIG. 3 is a functional block diagram of an exercise monitoring device according to an embodiment of the present invention constructed in the mobile phone shown in FIGS. 1 and 2.

FIG. 3 is a functional block diagram of the exercise monitoring device as one embodiment of the present invention constructed in the mobile phone 10 shown in FIGS. 1 and 2.

As functional blocks to be constructed in the mobile phone 10 shown in FIGS. 1 and 2, other than the pulse sensor 20 that is also shown in FIGS. 1 and 2, FIG. 3 shows a data setting section 201, a data storing section 202, a maximum-heart-rate-reserve conversion processing section 203, a pulse rate calculating section 204, an aerobic-exercise guidance processing section 205, an exercise-intensity/amount-of-exercise calculation processing section 206, and a notifying processing section 207.

In terms of hardware, the data setting section 201 mainly corresponds to elements such as the selection buttons 14 and the push buttons 15 shown in FIG. 1, and the key device 120 shown in FIG. 2. The followings are set by a user operation from the data setting section 201: a resting pulse rate of the user; age of the user; notice designation time that is a time interval for announcing whether or not the user is doing aerobic exercise and the like; whether or not an amount of exercise is notified at each notice designation time; and whether or not exercise intensity is notified.

Information set by the data setting section 201 is stored in the data storing section 202. In terms of hardware, the data storing section 202 mainly corresponds to the nonvolatile memory 112 shown in FIG. 2. In addition, data shown in FIGS. 4 and 5 which will be described next is stored beforehand in the data storing section 202.

FIG. 4 is a view showing a list of notice summary, notice timing, and notifying content.

FIG. 4 shows a list of "notice summary," "notice timing," and "notifying content"; in the list, the "notice summary" shows a summary of content to be notified to a user; the "notice timing" shows a timing for notifying the user; and the "notifying content" shows a content to be notified to the user at a time when the notice timing comes. In actual notice, a specific value is written in oo in the sentence of the "notifying content" shown in FIG. 4.

The list shown in FIG. 4 is stored beforehand in the data storing section 202 shown in FIG. 3.

FIG. 5 is a view showing a maximum heart rate reserve conversion table.

A list of "percentage with respect to the maximum heart rate reserve," "pulse rate," "exercise intensity," and "speed" is shown in the maximum heart rate reserve conversion table shown in FIG. 5. In the list, a column of the "pulse rate" is blank at the beginning; upon setting of a user's resting pulse rate and age by the user, a pulse rate to be written in the column of the "pulse rate" is calculated using those data set by the user, and is written in the column of the "pulse rate."

In this case, the maximum heart rate reserve (HR max reserve) is a difference between the maximum heart rate and a resting pulse rate (HR rest), and is represented by Equation (1) shown below.

$$\text{Maximum heart rate reserve}=[(220-\text{age})-\text{resting pulse rate}] \quad (1)$$

In addition, when a percentage with respect to the maximum heart rate reserve is set to x (%), a pulse rate to be written in the column of "pulse rate" is obtained by Equation (2) shown below.

$$\text{Pulse rate}=\text{Resting pulse rate}+[(220-\text{age})-\text{Resting pulse rate}]\times(x/100) \quad (2)$$

The "exercise intensity" is a numeric value in which METs is the unit, and relation with the "percentage with respect to the maximum heart rate reserve" is empirically, statistically obtained. In addition, the "speed" represents a speed of walking (or running) in which m/s is the unit. Relation with the "percentage with respect to the maximum heart rate reserve" of a numeric value in the column of the "speed" is empirically, statistically obtained as in the "exercise intensity."

In the present embodiment, when the "percentage with respect to the maximum heart rate reserve" is within a range of 50 to 59%, a user is notified that he/she is doing aerobic exercise; and when out of the range, a reminder is made to the user.

Returning to FIG. 3, the description will be continued.

In the maximum-heart-rate-reserve conversion processing section 203 shown in FIG. 3, the user's resting pulse rate and age stored in the data storing section 202 set by a user is used. In accordance with the aforementioned Equation (2), there is obtained respective pulse rates corresponding to the minimum value and the maximum value in respective segmentations (for example, if in the segmentation of 30 to 39%, the minimum value is 30% and the maximum value is 39%) such as 30 to 39%, 40 to 49%, . . . or the like in the column of the "percentage with respect to the maximum heart rate reserve" in the "maximum heart rate reserve conversion table" shown in FIG. 5; and the same is written in the column of the "pulse rate" in the "maximum heart rate reserve conversion table" shown in FIG. 5. In terms of hardware, the maximum-heart-rate-reserve conversion processing section 203 shown in FIG. 3 corresponds to the CPU 110 of the mobile phone 10 shown in FIG. 2; and the aforementioned pulse rate is obtained by an arithmetic processing by a program executed by the CPU 110.

In addition, the pulse rate calculating section 204 shown in FIG. 3 has the role of receiving a signal in synchronization with a pulse in blood flow from the pulse sensor 20, calculating the current user's pulse rate, and notifying the same to the aerobic-exercise guidance processing section 205 and the exercise-intensity/amount-of-exercise calculation processing section 206. In terms of hardware, the pulse rate calculating section 204 mainly corresponds to the pulse measuring device 123 shown in FIG. 2.

Furthermore, the aerobic-exercise guidance processing section 205 shown in FIG. 3 receives the current user's pulse rate calculated by the pulse rate calculating section 204; and the "percentage with respect to the maximum heart rate reserve" or the like corresponding to the current user's pulse rate is obtained with reference to the maximum heart rate reserve conversion table (see FIG. 5) stored in the data storing section 202. Then, according to whether or not a percentage with respect to the maximum heart rate reserve corresponding to the current pulse rate is matched with a percentage with respect to the maximum heart rate reserve corresponding to aerobic exercise, calculation is made (to be described later) and a calculated result is given to the notifying processing section 207. The notifying processing section 207 receives the calculated result and notifies the user whether or not aerobic exercise is being appropriately performed at present, whether or not the aerobic exercise needs to be increased in speed, and whether or not the aerobic exercise needs to be decreased in speed. Calculation content at the aerobic-exercise guidance processing section 205 and notifying content at the notifying processing section 207 will be described later in detail.

The exercise-intensity/amount-of-exercise calculation processing section 206 shown in FIG. 3 receives the current pulse rate of the user calculated by the pulse rate calculating section 204, acquires exercise intensity (METs) corresponding to the current user's pulse rate with reference to the maximum heart rate reserve conversion table (see FIG. 5)

stored in the data storing section 202, converts the acquired exercise intensity (METs) to an amount of exercise, and obtains an accumulated amount of exercise by adding the amount of exercise obtained by the conversion to the amount of exercise accumulated so far. In this case, the unit of the amount of exercise is represented in METs·h. The exercise-intensity/amount-of-exercise calculation processing section 206 acquires exercise intensity (METs) every one second; therefore, the amount of exercise for one second is calculated by Equation (3) shown below, and the amount of exercise calculated this time is added to the amount of exercise accumulated so far.

$$\text{Amount of exercise } (MET{\cdot}h) = \text{Exercise intensity } (METs) \times (1/3600) \quad (3)$$

The exercise intensity (METs) obtained by the exercise-intensity/amount-of-exercise calculation processing section 206 and the accumulated amount of exercise (METs·h) are also provided to the notifying processing section 207; and the notifying processing section 207 notifies the same to the user when notification of the same has been set by the user.

Figure 6:
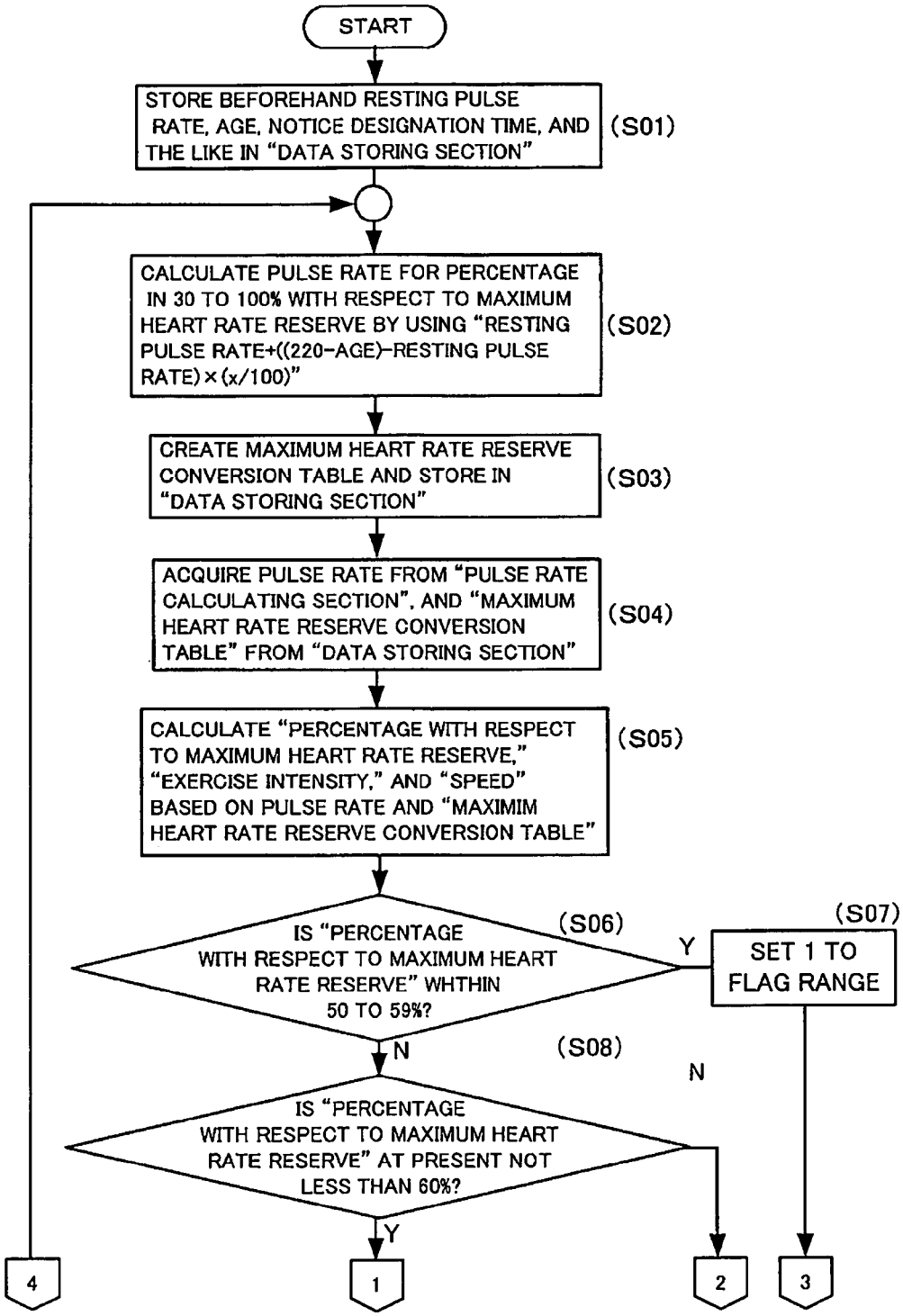
FIG. 6 is a view showing a first half portion of a flow chart of an exercise monitoring program which makes a mobile phone operate as an exercise monitoring device.
Figure 7:
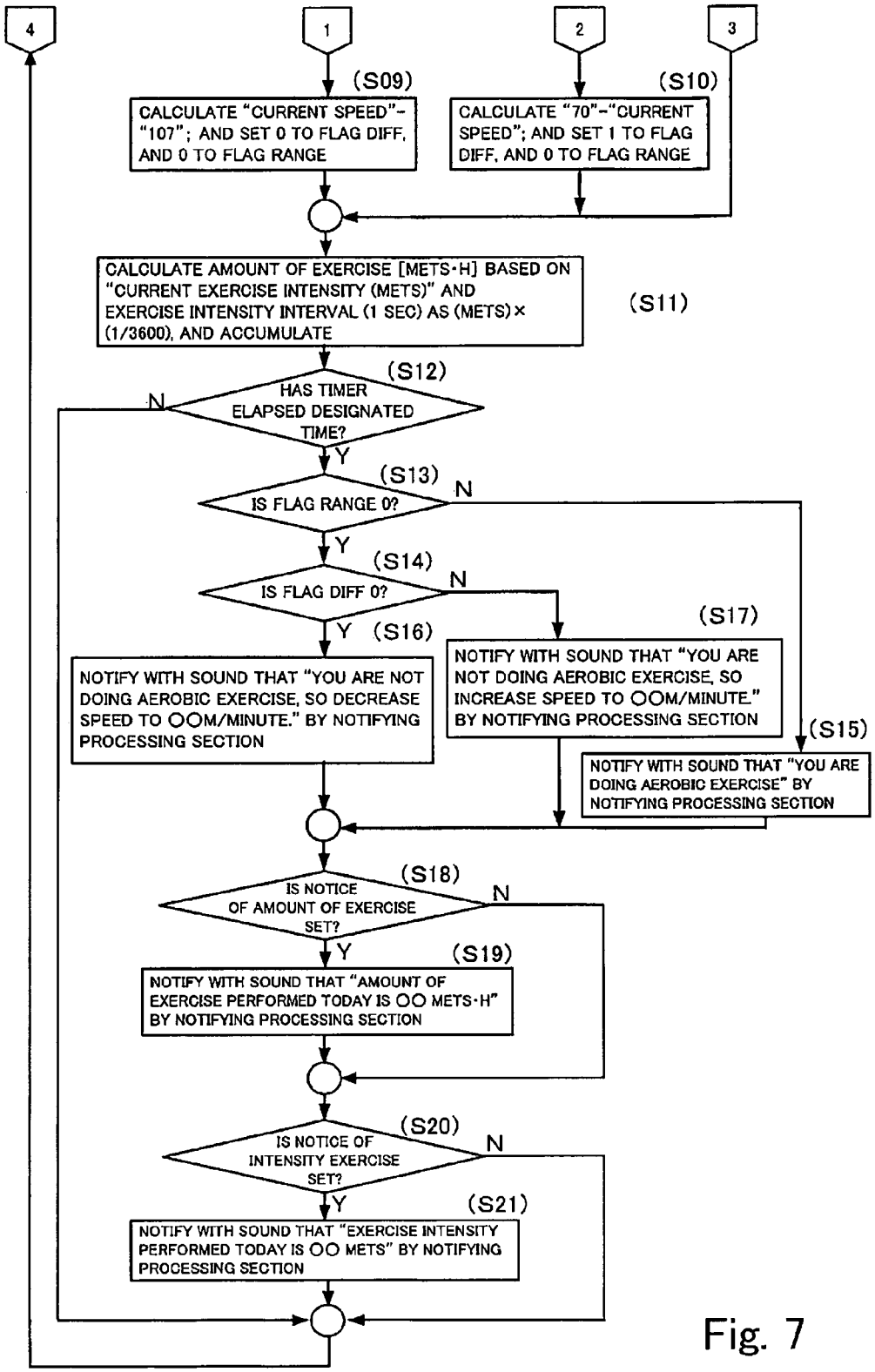
FIG. 7 is a view showing a second half portion of the flow chart of the exercise monitoring program which makes the mobile phone operate as the exercise monitoring device.

FIGS. 6 and 7 respectively show the first half portion and the second half portion of the flow chart of the exercise monitoring program that makes the mobile phone, which is executed by the CPU 110 of the mobile phone 10 shown in FIGS. 1 and 2, operate as the exercise monitoring device represented by the functional block diagram shown in FIG. 3.

First, by user's operation, a resting pulse rate, age, notice designation time, and the like are set and stored beforehand in the data storing section 202 (see FIG. 3) (step S01).

Next, the maximum-heart-rate-reserve conversion processing section 203 calculates a pulse rate corresponding to upper and lower limits in the respective segmentations in the column of the percentage with respect to the maximum heart rate reserve in the maximum heart rate reserve conversion table shown in FIG. 5 on the basis of the Equation (2) (step S02), and writes the same in the maximum heart rate reserve conversion table (step S03).

Then, the aerobic-exercise guidance processing section 205 and the exercise-intensity/amount-of-exercise calculation processing section 206 acquire the current user's pulse rate calculated by the pulse rate calculating section 204 and the maximum heart rate reserve conversion table stored in the data storing section 202 (step S04); and on the basis of the same, the "percentage with respect to the maximum heart rate reserve" corresponding to the current pulse rate and the current "exercise intensity" and "speed" are obtained (step S05).

Next, it is determined whether or not the current "percentage with respect to the maximum heart rate reserve" obtained in step S05 is within 50 to 59% that is a percentage with respect to the maximum heart rate reserve suitable for aerobic exercise (step S06); and when the aforementioned percentage is within 50 to 59%, a flag "range" representing that aerobic exercise is being performed is set to 1 (step S07).

On the other hand, when the aforementioned percentage is not within 50 to 59% in step S06; next, in step S08, it is determined whether or not the current "percentage with respect to the maximum heart rate reserve "is not less than 60%. When the aforementioned percentage is not less than 60%, the current exercise intensity is too strong; and the process proceeds to step S09 shown in FIG. 7. At the same time, when the aforementioned percentage is less than 60%, since it is known in step S06 that the aforementioned percentage is not within 50 to 59%, the percentage is less than 49%; therefore, the current exercise intensity is too weak, and the process proceeds to step S10 shown in FIG. 7.

In step S09 shown in FIG. 7, since the exercise intensity is too strong, "the current speed"−"107" is calculated; and, a flag "diff" representing the level (strong or weak) of the exercise intensity is set to 0, and a flag "range," which represents that aerobic exercise is being performed, is set to 0, because too strong exercise intensity is not appropriate to be regarded as the aerobic exercise.

In this case, "107" is the upper limit of a range of 70 to 107 of the "speed" at a time when the "percentage with respect to the maximum heart rate reserve" for aerobic exercise is within a range of 50 to 59% (see FIG. 5). Therefore, a value of "the current speed"−"107" is a difference between the upper limit "107" and the current speed which needs to be decreased to be brought into the range of aerobic exercise.

On the other hand, in step S10 shown in FIG. 7, since the exercise intensity is too weak, "70"−"the current speed" is calculated, and, the flag "diff" representing the level (strong or weak) of the exercise intensity is set to 1, and the flag "range" representing that aerobic exercise is being performed is set to 0, because the current exercise is not appropriate to be regarded as the aerobic exercise. In this case, "70" is the lower limit of the range of 70 to 107 of the "speed" at a time when the "percentage with respect to the maximum heart rate reserve" for aerobic exercise is within the range of 50 to 59% (see FIG. 5). Therefore, a value of "70"−"the current speed" is a difference between the lower limit "70" and the current speed which needs to be increased to be brought into the range of aerobic exercise.

Step S11 represents operation of the exercise-intensity/amount-of-exercise calculation processing section 206 shown in FIG. 3, an amount of exercise (METs·h) for 1 sec at this time is calculated from the current exercise intensity (METs) and an exercise intensity calculation interval (1 sec), and is added to the amount of exercise accumulated so far.

In step S12, it is determined whether or not notice designation time for notifying a user has elapsed; when the notice designation time has not elapsed yet, the process returns to step S02, and the steps described so far are repeated at 1 sec interval.

In step S12, when it is determined that the notice designation time has elapsed, next, the process proceeds to step S13, and it is determined whether or not the flag "range" representing that the aerobic exercise is being performed is 0. When the flag "range" is 1, the process proceeds to step S15, where it is notified with sound that "you are doing aerobic exercise" by the notifying processing section 207 shown in FIG. 3.

In addition, when it is determined that the flag "range" is 0 in step S13, which is out of the range of the aerobic exercise; next, the process proceeds to step S14, and it is determined whether or not the flag "diff" is 0; when the flag "diff" is 0, the process proceeds to step S16; when the flag "diff" is 1, the process proceeds to step S17. When the process proceeds to step S16, it is in a state that the current exercise intensity is too strong. In step S16, the user is notified with sound that "you are not doing aerobic exercise, so decrease the speed to oo m per minute" by the notifying processing section 207 with reference to the list shown in FIG. 4, which is stored in the data storing section 202. In this case, a numeric value of oo m per minute is "the current speed"−"107," which is calculated in step S09.

On the other hand, when the process proceeds to step S17, the user is in a state that the current exercise intensity is too weak. In step S17, it is notified with sound that "you are not doing aerobic exercise, so increase the speed to oo m per minute" by the notifying processing section 207 with reference to the list shown in FIG. 4, which is stored in the data storing section 202. In this case, oo of the "increase in speed at oo m per minute" is "70"–"the current speed," which is calculated in step S10.

Next, in step S18, it is determined whether or not notification of amount of exercise is set; and when notification of amount of exercise is set, in step S19, it is notified with sound that "the amount of exercise this time is oo METs·h" by the notifying processing section 207 with reference to the list shown in FIG. 4, which is stored in the data storing section 202. In this case, oo of the "oo METs·h" is a cumulative amount of exercise calculated in step S11.

Next, in step S20, it is determined whether or not notification of exercise intensity is set; and when notification of exercise intensity is set, in step S21, it is notified with sound that "exercise intensity at the moment is oo METs" by the notifying processing section 207 with reference to the list shown in FIG. 4, which is stored in the data storing section 202. In this case, oo of the "oo METs" is exercise intensity acquired from the maximum heart rate reserve conversion table (see FIG. 5) in step S05.

When these steps are completed, the process returns to step S02 shown in FIG. 6, and the steps described so far are repeated at 1 sec interval.

FIG. 8 is a view showing a list of notice summary, timing, and notifying content as an alternative to the list shown in FIG. 4.

In FIG. 8, sentences are made so as to notify exercise intensity (METs) in which aerobic exercise is being performed when the exercise intensity is excessive or insufficient.

In FIG. 4, notification of speed to a user is set; instead however, as shown in FIG. 8, exercise intensity (METs) may be notified.

In addition, the aforementioned embodiments are described about embodiments incorporated in a mobile phone; however, these may be incorporated in an exercise machine or the like in place of being incorporated in a mobile phone.

What is claimed is:

1. An information processing device comprising:

a first storage section configured to store in advance range of percentages with respect to a maximum heart rate reserve and suitable as aerobic exercise, and exercise intensity expressed in METs for each range of percentage;

a second storage section configured to, in response to acquisition of an age and a resting pulse rate of a user, associate and store, with the exercise intensity, range of pulse rates obtained by multiplying the maximum heart rate reserve determined based on the age and the resting pulse rate of the user by an upper limit and a lower limit defining the range of percentages;

an exercise intensity acquiring section that, in response to reception of a current pulse rate of the user inputted from a sensor, compares the current pulse rate with the range of pulse rates in the second storage section, and obtains the exercise intensity associated with the range of pulse rates in the second storage section to which range of pulse rate the current pulse rate belongs; and a notification processing section that produces notifying content for the user based on the obtained exercise intensity.

2. A non-transitory computer-readable storage medium having program code stored in a memory when executed by a processor, the computer readable storage medium comprising:

program code to access a first storage section configured to store in advance range of percentages with respect to a maximum heart rate reserve and suitable as aerobic exercise, and exercise intensity expressed in METs for each range of percentage;

program code to, in response to acquisition of an age and a resting pulse rate of a user, associate and store, with the exercise intensity, range of pulse rates obtained by multiplying the maximum heart rate reserve determined based on the age and the resting pulse rate of the user by an upper limit and a lower limit defining the range of percentages, in a second storage section;

program code to, in response to reception of a current pulse rate of the user inputted from a sensor, compares the current pulse rate with the range of pulse rates in the second storage section, and obtains the exercise intensity associated with the range of pulse rates in the second storage section to which range of pulse rate the current pulse rate belongs; and program code to produce notifying content for the user based on the obtained exercise intensity.

* * * * *